United States Patent [19]

Franke

[11] 4,373,144

[45] Feb. 8, 1983

[54] CATHODE ARRANGEMENT FOR AN X-RAY TUBE

[75] Inventor: Kurt Franke, Erlangen, Fed. Rep. of Germany

[73] Assignee: Siemens Aktiengesellschaft, Berlin & Munich, Fed. Rep. of Germany

[21] Appl. No.: 217,216

[22] Filed: Dec. 17, 1980

[30] Foreign Application Priority Data

Jan. 14, 1980 [DE] Fed. Rep. of Germany ..... 3001141

[51] Int. Cl.[3] ..... H01J 1/20; H01J 35/00

[52] U.S. Cl. ..... 313/338; 378/136

[58] Field of Search ..... 313/338, 56; 378/134, 378/136, 138

[56] References Cited

U.S. PATENT DOCUMENTS

| | | | |
|---|---|---|---|
| 2,068,287 | 1/1937 | Gabor | 313/338 |
| 2,110,604 | 3/1938 | Langhans et al. | 378/134 |
| 2,215,426 | 9/1940 | Machlett | 378/134 |
| 3,649,861 | 3/1972 | Atlee et al. | 378/134 |
| 4,266,133 | 5/1981 | Weigel | 378/134 |

*Primary Examiner*—Harold A. Dixon

*Attorney, Agent, or Firm*—Hill, Van Santen, Steadman, Chiara & Simpson

[57] ABSTRACT

In an exemplary embodiment, a cathode cup for electron focusing has a groove-like cavity for the heater coil. The cathode cup is subdivided, approximately perpendicularly to the longitudinal direction of the heater coil into several parts which are insulated from one another, to which separate control potentials can be supplied.

2 Claims, 3 Drawing Figures

CATHODE ARRANGEMENT FOR AN X-RAY TUBE

BACKGROUND OF THE INVENTION

The invention relates to a cathode arrangement for an x-ray tube comprising a cathode cup for electron focusing which exhibits a groove-like cavity for the heater coil.

In the case of cathode arrangements of this type, it is known to influence the size of the focal spot by changing the potential of the cathode cup or by changing the position of the heater coil in the cathode cup. The deeper the heater coil lies in the groove-like cavity of the cathode cup, namely, the smaller the focal spot. However, through these measures, it is virtually only possible to influence the linear focal spot in its one direction; namely, in its smaller dimension. The other dimension; namely, the longitudinal dimension of the focal spot, can hardly be influenced in the case of the known x-ray tubes.

SUMMARY OF THE INVENTION

The object underlying the invention resides in creating a cathode arrangement of the type initially cited which permits the possibility of influencing the dimension of the focal spot in all directions.

In accordance with the invention, this object is achieved in that the cathode cup is subdivided, approximately perpendicularly to the longitudinal direction of the heater coil, into several parts which are insulated from one another, to which separate control potentials can be supplied. In the case of the inventive cathode arrangement, a respectively different grid potential can be supplied to several parts of the cathode cup. Via these grid potentials the dimension of the rectangular focal spot can be influenced in length as well as in width.

The invention shall be explained in greater detail below on the basis of an exemplary embodiment illustrated on the accompanying drawing sheet; and other objects, features and advantages will be apparent from this detailed disclosure and from the appended claims.

DETAILED DESCRIPTION

Figure 1:
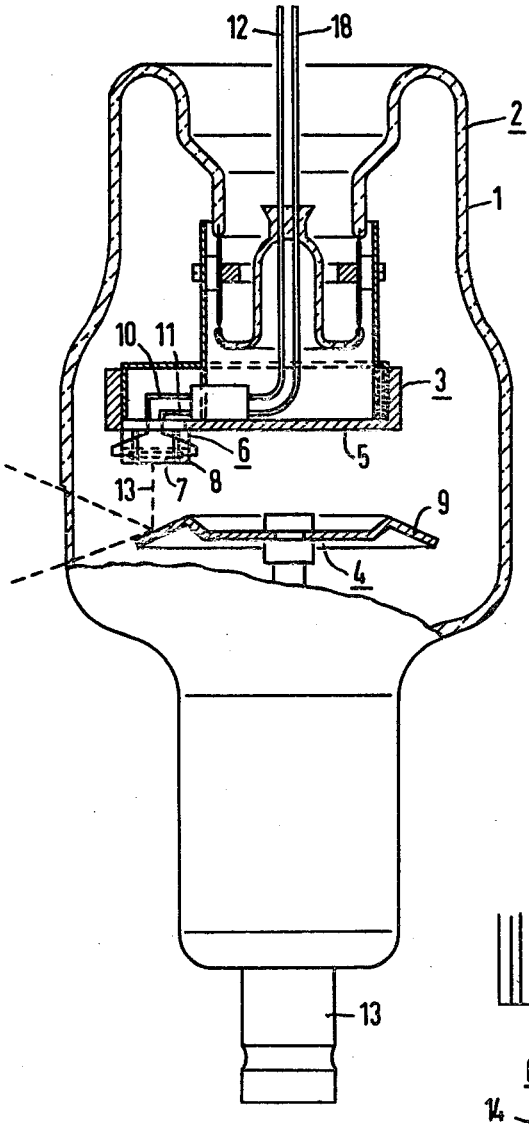
FIG. 1 illustrates an x-ray tube with a cathode arrangement according to the invention.

In FIG. 1, 1 designates the glass envelope of an x-ray tube 2. In the interior of the envelope 1 a cathode arrangement 3 is provided at one end and an anode arrangement 4 is provided at the opposite end. The cathode arrangement 3 exhibits a cathode cup 6 on its housing 5. The latter cup contains a heater coil 7 which is illustrated only schematically in FIGS. 1–3. The heater coil 7 lies in a groove-like cavity 8 of the cathode cup 6, which serves the purpose of focusing. Disposed opposite the heater coil 7 is the anode 9 which is designed in the form of a rotating disk anode. For operation of the heater coil 7, a filament voltage is connected via lines 10 and 11 to the heater coil 7. The high voltage is supplied to the x-ray tube 2 via a line 12 and a connection piece 13 connected to the anode end of the x-ray tube 2. The connection piece 13 accelerates the electrons emerging from the heater coil 7 corresponding to the high voltage supplied to the anode.

Figure 2:
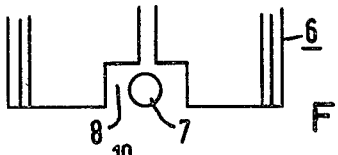
FIG. 2 is a diagrammatic view of the parts of the cathode arrangement of the x-ray tube according to FIG. 1, which parts are significant in terms of the invention, on an enlarged scale and rotated 90°.
Figure 3:
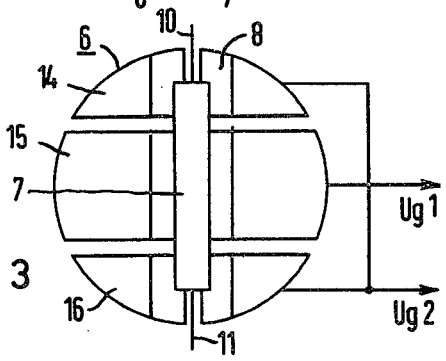
FIG. 3 illustrates a plan view of the cathode arrangement according to FIG. 2; i.e., a view of the cathode arrangement viewed from the anode.

From FIGS. 2 and 3 it is apparent that the cathode cup 6, perpendicularly to the longitudinal direction of the heater coil 7, is subdivided into several; namely, into three parts 14, 15, 16, which are insulated from one another. Separate control potentials can be supplied to the parts 14, 15, 16 of the cathod cup 6. It is thereby possible to influence the dimensions of the focus in the longitudinal direction as well as in transverse direction via these control potentials. In the exemplary embodiment, part 15 is supplied with a control potential Ug1. The control potential Ug2 is connected to the parts 14 and 16.

It is possible to subdivide the cathode cup 6 - which is approximately cylindrical on its exterior surface - in direction of the longitudinal axis, less than or more than twice, in case this is necessary for a corresponding influencing of the focus dimensions.

In the exemplary embodiment it is regarded as sufficient if the cathode cup 6 is subdivided, perpendicularly to the longitudinal direction of the heater coil 7, into three parts 14, 15, 16, each having a dimension which is approximately equally as great as that of the other two in this longitudinal direction, each such longitudinal dimension at the central longitudinal axis of cup 6 being approximately equal to one-third of the diameter of cup 6 as seen in FIG. 3.

It will be apparent that many modifications and variations may be effected without departing from the scope of the novel concepts and teachings of the present invention.

I claim as my invention:

1. A cathode arrangement for an x-ray tube comprising a cathode cup for electron focusing having a groove-like cavity and having a heater coil extending in a longitudinal direction in said cavity, said cathode cup (6) being subdivided approximately perpendicularly to the longitudinal direction of the heater coil (7) to define several parts (14, 15, 16) which are insulated from one another, and means for applying separate control potentials (Ug1, Ug2) to said parts (15; 14, 16).

2. A cathode arrangement according to claim 1, with the cathode cup (6) consisting of three parts (14, 15, 16) each having a dimension in the longitudinal direction of the heater coil (7) which is approximately equally as great as the corresponding dimension of the other two parts.

* * * * *